US006688855B2

(12) United States Patent
Beckerman

(10) Patent No.: US 6,688,855 B2
(45) Date of Patent: Feb. 10, 2004

(54) APPARATUS FOR INCREASING WATER PRESSURE

(76) Inventor: Jan Beckerman, 666 Shore Rd., Apartment 3H, Long Beach, NY (US) 11561

( * ) Notice: Subject to any disclaimer, the term of this patent is extended or adjusted under 35 U.S.C. 154(b) by 38 days.

(21) Appl. No.: 09/920,594

(22) Filed: Aug. 2, 2001

(65) Prior Publication Data

US 2003/0026712 A1 Feb. 6, 2003

(51) Int. Cl.[7] ..... F04B 49/00; A47K 3/28
(52) U.S. Cl. ..... 417/307; 4/603
(58) Field of Search ..... 417/307, 308, 417/309; 4/603, 605, 615, 567, 568, 570

(56) References Cited

U.S. PATENT DOCUMENTS 5,206,963 A * 5/1993 Wiens ..... 4/603
6,053,702 A * 4/2000 Sears ..... 417/26
6,227,808 B1 * 5/2001 McDonough ..... 417/44.2
6,481,028 B1 * 11/2002 Hsia ..... 4/570
6,581,220 B2 * 6/2003 Yekutiely et al. ..... 4/661
6,604,909 B2 * 8/2003 Schoenmeyr ..... 417/32

FOREIGN PATENT DOCUMENTS

JP 02001137144a * 5/2001 ..... A47K/3/28

* cited by examiner

*Primary Examiner*—Sang Y. Paik
*Assistant Examiner*—Vinod D. Patel
(74) *Attorney, Agent, or Firm*—Robert L. Epstein, Esq.; Harold James, Esq.; James & Franklin, LLP

(57) ABSTRACT

A water diverter assembly is mounted between the supply pipe and showerhead. It includes an inlet passage and outlet passage connected by a bypass valve. A remote pump is connected by inlet and outlet hoses between the inlet passage and the outlet passage, respectively. A pressure sensitive switch actuates the pump only when water pressure above a preset level is sensed at the supply pipe. The water pressure at the shower head is controlled by the bypass valve.

10 Claims, 2 Drawing Sheets

APPARATUS FOR INCREASING WATER PRESSURE

Figure 1:
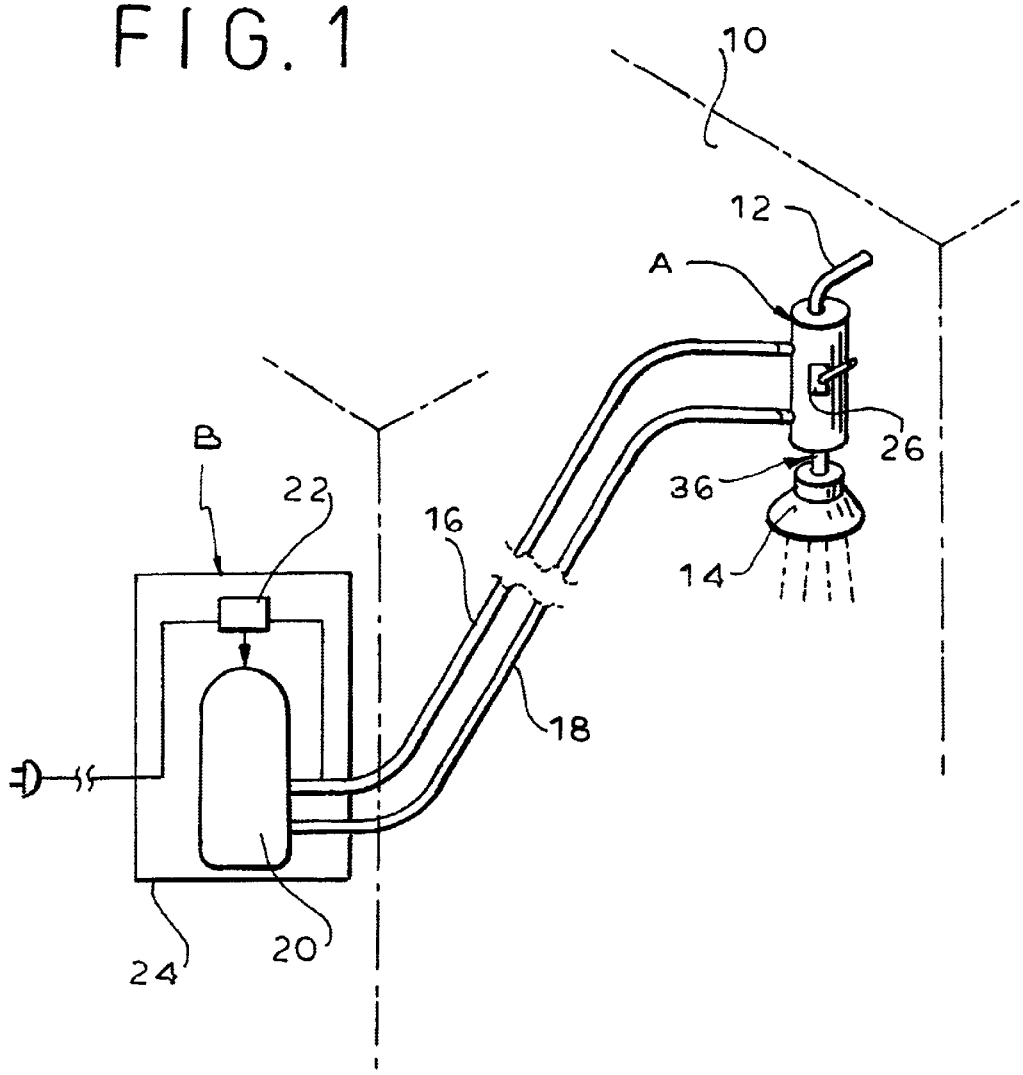

The present invention relates to plumbing for bathrooms and more particularly to apparatus for increasing the water pressure to a showerhead.

Many residential showers deliver water to the showerhead that has less pressure than desired. This is particularly true in highrise rental buildings where water service is limited and many showers may be in use simultaneously.

While insufficient water pressure from the showerhead may decrease the enjoyment of the shower generally, it is particularly noticeable when a showerhead with an internal water driven massage feature is used. Such showerheads are designed for use with water supplied above a specific pressure and do not work efficiently below that pressure.

It is, therefore, a prime object of the present invention to provide apparatus for increasing water pressure to a showerhead or the like.

It is another object of the present invention to provide apparatus for increasing water pressure designed to be used with a conventional shower including a water diverter assembly situated between the supply pipe and showerhead and a pump located at a remote location outside the shower enclosure.

It is another object of the present invention to provide apparatus for increasing water pressure wherein the water pressure can be controlled from within the shower enclosure.

It is another object of the present invention to provide apparatus for increasing the water pressure in which the remote pump is automatically actuated when the water is turned on.

In accordance with the present invention, apparatus is provided for increasing water pressure to a showerhead or the like of the type adapted to be connected to a shower supply pipe. The apparatus includes a water diverter assembly designed to be operably interposed between the supply pipe and the showerhead. Remote pump means are connected to the assembly. Means for energizing the remote pump means are also provided.

The assembly includes inlet means connected to the supply pipe. Means are provided for connecting the inlet means and the pump means. Outlet means are connected to the showerhead. Means are provided for connecting the pump means and the outlet means.

The assembly includes bypass means operably interposed between the inlet means and the outlet means. The bypass means includes a bypass passage extending between the inlet means and the outlet means. A valve situated in the bypass passage regulates the amount of water passing through the bypass passage.

The pump means is situated within an enclosure remote from the shower.

The pump means energizing means includes a switch. The switch has means for sensing the pressure of water in the means for connecting the inlet means and the pump means. Means are provided for actuating the pump means when pressure above a given level is sensed.

The supply pipe has an externally threaded end portion. The inlet means includes an inlet passage within the assembly with an internally threaded portion adapted to engage the end portion of the supply pipe.

The means for connecting the inlet means and the pump means includes a first connector operably connected to the inlet passage and a first hose connected to the first connector.

The outlet means includes an outlet passage in the assembly. An externally threaded pipe section is connected to the outlet passage and is adapted to receive the showerhead.

The means for connecting the outlet means and the pump means includes a second connector operably connected to the outlet passage and a second hose connected to the second connector.

Figure 2:
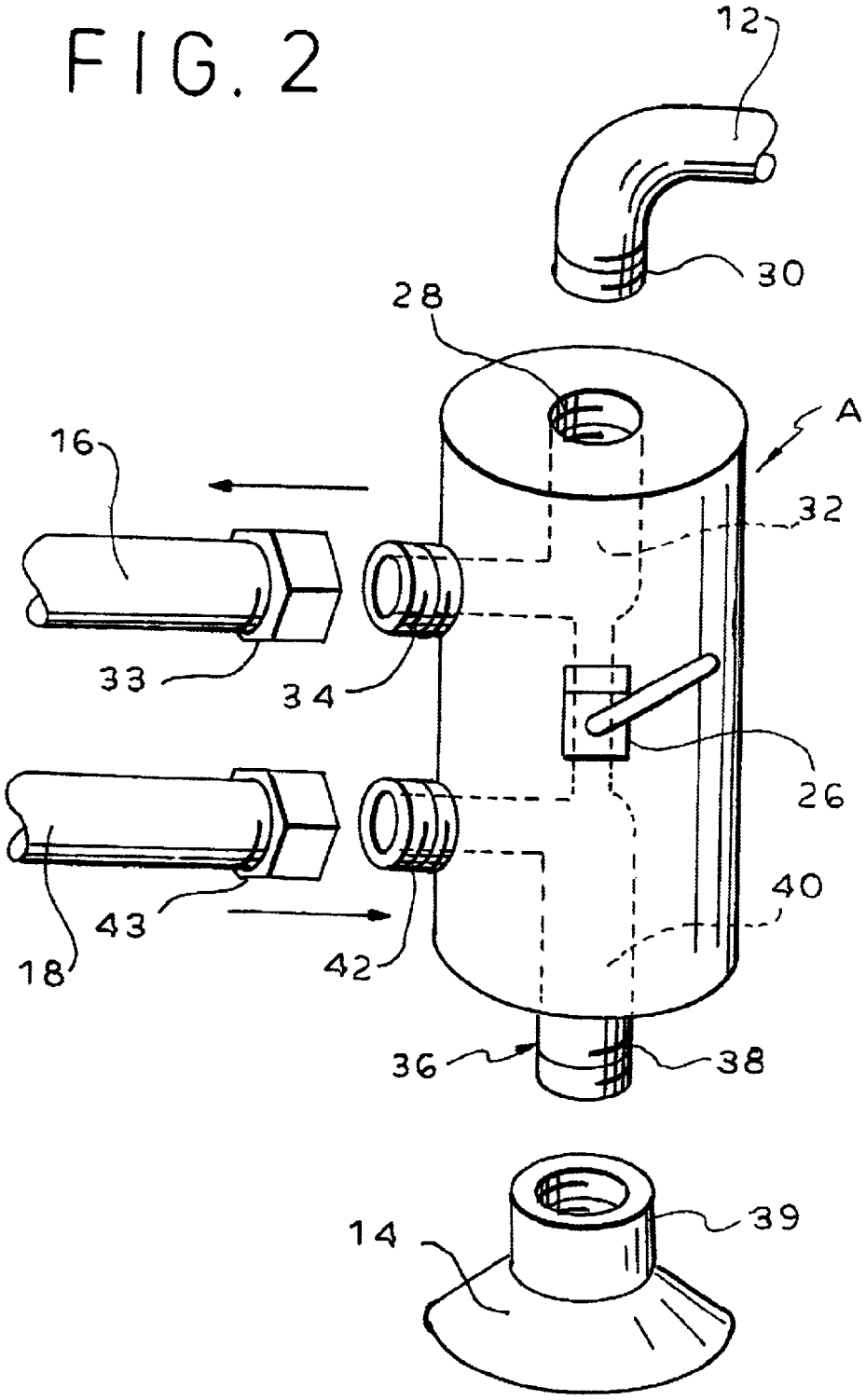

To these and to such other objects as may hereinafter appear, the present invention relates to apparatus for increasing water pressure to a showerhead or the like as described in detail in the following specification, recited in the annexed claims and illustrated in the accompanying drawings, wherein like numbers refer to like parts and in which:

FIG. 1 is a schematic drawing showing a shower enclosure, the water diverter assembly installed in the shower enclosure, the remote pump and the connecting hoses; and FIG. 2 is a cross-sectional view showing the internal structure of the water diverter assembly.

As seen in the drawings, the apparatus of the present invention includes a water diverter assembly, generally designated A, designed to be mounted within a conventional shower enclosure 10, between the water supply pipe 12 and a showerhead 14. Assembly A is connected by two flexible hoses 16, 18 to a remote pump unit, generally designated B, located outside of enclosure 10. The pump unit B includes a water pump 20 and a water pressure sensitive switch 22 situated within a housing 24.

Situated on assembly A is a control valve 26. Valve 26 permits one to regulate the pressure of the water supplied to the showerhead from inside the shower enclosure.

Turning on the faucets in the shower causes water to flow through supply pipe 12, assembly A and hose 16 to pump 20, located safely away from the shower enclosure to prevent electric shock. Switch 22 within housing 24 senses the water in hose 16 and actuates the pump. Once actuated, pump 20 pumps water through hose 18, through assembly A and into showerhead 14. Valve 26 regulates the pressure of the water supplied to the showerhead.

Switch 22 is preferably a model #9013FRG22 reverse actuating pressure switch available from the Square D Company, 8001 Highway 64 East, Knightdale, N.C. 27545-9023 or the equivalent. The switch, sold under the trademark PUMPTROL, is diaphragm actuated. The contacts close to connect the pump to a source of electricity upon sensing pressure rising above a preset level (trip point) and open upon sensing falling pressure below a preset level (reset point) to turn off the pump. The trip and reset points can be adjusted.

Pump 20 can be a utility pump of ⅓ to ½ horsepower, such as a self-priming pump manufactured and sold by W. W. Grainger, Inc., 100 Grainger Parkway, Lake Forest, Ill. 60045 as Model 2P110, under the brand name TEEL, or the like. It is energized from a standard 110 volt outlet through the contacts in switch 22 whenever water of a pressure above the trip point is sensed in hose 16 and is turned off when the pressure sensed in hose 16 falls below the reset point. Accordingly, the pump is actuated by turning the faucet in the shower on and deactivated when the water is turned off.

As best seen in FIG. 2, assembly A has an internally threaded cylindrical inlet recess 28 which receives the externally threaded section 30 of supply pipe 12. Recess 28 is the entrance to an inlet passage 32 which leads to a connector 34. The end of hose 16 is an internally threaded connector 33 which is received on externally threaded connector 34.

Extending from the bottom of assembly A is a connector 36 with an externally threaded section 38. Section 38 is adapted to be received in the internally threaded neck 39 of showerhead 14. Connector 36 is the end of an outlet passage 40 which leads to connector 42. The end of hose 18 is an internally threaded connector 43 which is received on externally threaded connector 42.

A bypass passage, preferably of smaller diameter than passages 32 and 40, connects passages 32 and 40 through a conventional valve 26 which permits a controlled amount of water to bypass the pump. Hence, valve 26 reduces the pressure to the showerhead when opened by an amount proportional to the degree to which the valve is open.

It should now be appreciated that the present invention is an apparatus for increasing water pressure to a showerhead. It includes a water diverter assembly designed for easy and quick installation in a conventional shower. The assembly is mounted between the supply pipe and the showerhead and has a bypass valve which controls the water pressure to the shower head from inside the shower enclosure. The assembly is connected by hoses to a remote pump located in housing. A pressure sensitive switch in the housing turns the pump on and off with the water supply.

While only a single preferred embodiment of the present invention has been disclosed for purposes of illustration, it is obvious that many variations and modifications could be made thereto. It is intended to cover all of these variations and modifications which fall within the scope of the invention, as defined by the following claims:

I claim:

1. Apparatus for increasing water pressure to a showerhead or the like located within a shower enclosure of the type which is adapted to be connected to a supply pipe comprising a water diverter assembly operably interposed between the supply pipe and the showerhead, pump means located outside the shower enclosure, means for connecting said assembly and said pump means and means for energizing said pump means, said pump means energizing means comprising a water pressure sensitive switch for sensing the pressure of the water in said connecting means and for energizing said pump where the sensed water pressure exceeds a given level, said switch being situated outside the shower enclosure.

2. The apparatus of claim 1 wherein said assembly comprises inlet means adapted to be connected to the supply pipe, means for connecting said inlet means and said pump means, outlet means adapted to be connected to the showerhead and means for connecting said pump means and said outlet means.

3. The apparatus of claim 2 wherein said assembly further comprises bypass means operably interposed between said inlet means and said outlet means.

4. The apparatus of claim 3 wherein said bypass means comprises a bypass passage extending between said inlet means and said outlet means and a valve located in said bypass passage.

5. The apparatus of claim 1 wherein said pump means is situated within a housing remote from the apparatus.

6. The apparatus of claim 2 wherein said switch comprises means for sensing the pressure of water in said inlet means.

7. The apparatus of claim 2 wherein the supply pipe has an externally threaded end portion and said inlet means comprises an inlet passage with an internally threaded portion adapted to engage said end portion of the supply pipe.

8. The apparatus of claim 7 wherein said means for connecting said inlet means and said pump means comprises a first connector operably connected to said inlet passage and a first hose connected to said first connector.

9. The apparatus of claim 7 wherein outlet means comprises an outlet passage having an externally threaded pipe section adapted to receive the showerhead.

10. The apparatus of claim 9 wherein said means for connecting said outlet means and said pump means comprises a second connector associated with said outlet passage and a second hose connected to said second connector.

* * * * *